US011384677B2

(12) United States Patent
Suzuki et al.

(10) Patent No.: US 11,384,677 B2
(45) Date of Patent: Jul. 12, 2022

(54) STATE ESTIMATION APPARATUS

(71) Applicant: DENSO CORPORATION, Kariya (JP)

(72) Inventors: Hiroshi Suzuki, Kariya (JP); Yasuhiro Kawakatsu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/345,170

(22) Filed: Jun. 11, 2021

(65) Prior Publication Data

US 2021/0301709 A1 Sep. 30, 2021

Related U.S. Application Data

(63) Continuation of application No. PCT/JP2019/047483, filed on Dec. 4, 2019.

(30) Foreign Application Priority Data

Dec. 12, 2018 (JP) ..... JP2018-232183

(51) Int. Cl.
*F01N 11/00* (2006.01)
*F01N 3/10* (2006.01)

(52) U.S. Cl.
CPC ..... *F01N 11/007* (2013.01); *F01N 3/101* (2013.01); *F01N 11/00* (2013.01); *F01N 2550/02* (2013.01); *F01N 2900/1402* (2013.01); *F01N 2900/1411* (2013.01); *F01N 2900/1624* (2013.01)

(58) Field of Classification Search
CPC ..... F01N 11/007; F01N 2250/02; F01N 2900/1402; F01N 2900/1411; F01N 2900/1624; F01N 11/00; F01N 3/101; F02D 45/00
See application file for complete search history.

(56) References Cited

U.S. PATENT DOCUMENTS 5,678,402 A 10/1997 Kitagawa et al.
5,842,340 A * 12/1998 Bush ..... F02D 41/0295 60/274
6,289,673 B1 * 9/2001 Tayama ..... F02D 41/0295 60/274
6,499,290 B1 * 12/2002 Nakamura ..... F02D 41/0295 60/274

(Continued)

FOREIGN PATENT DOCUMENTS

JP 2005-098205 4/2005
JP 2018-162722 10/2018

*Primary Examiner* — Matthew T Largi
(74) *Attorney, Agent, or Firm* — Nixon & Vanderhye P.C.

(57) ABSTRACT

A state estimation apparatus includes: a rate calculating configured to calculate, based on both a flow rate and an air-fuel ratio of exhaust gas flowing into an oxygen storage catalyst, a rate of change in an oxygen storage amount in the oxygen storage catalyst; a limit calculating unit configured to calculate a limit rate which is a limit value for the rate of change; and a storage-amount updating unit configured to update, based on the rate of change and the limit rate, an estimated value of the oxygen storage amount. Moreover, the storage-amount updating unit is further configured to: update, when the rate of change does not exceed the limit rate, the estimated value based on the rate of change; and update, when the rate of change exceeds the limit rate, the estimated value based on the limit rate.

9 Claims, 6 Drawing Sheets

(56) References Cited

U.S. PATENT DOCUMENTS

| | | | | |
|---|---|---|---|---|
| 6,622,479 | B2 * | 9/2003 | Kakuyama | F01N 11/007 60/285 |
| 6,637,195 | B2 * | 10/2003 | Sakai | F02D 41/0295 60/274 |
| 2001/0022082 | A1 * | 9/2001 | Oguma | F01N 9/005 60/285 |
| 2002/0023432 | A1 * | 2/2002 | Ishizuka | B01D 53/9495 60/285 |
| 2003/0017603 | A1 | 1/2003 | Uchida et al. | |
| 2004/0144079 | A1 * | 7/2004 | Nagai | F02D 41/1465 60/276 |
| 2017/0067386 | A1 | 3/2017 | Kawakatsu | |

* cited by examiner

STATE ESTIMATION APPARATUS

CROSS-REFERENCE TO RELATED APPLICATIONS

The present application is a continuation application of International Application No. PCT/JP2019/047483 filed on Dec. 4, 2019, which is based on and claims priority from Japanese Patent Application No. 2018-232183 filed on Dec. 12, 2018. The entire contents of these applications are incorporated by reference into the present application.

BACKGROUND

1. Technical Field

The present disclosure relates to a state estimation apparatus for estimating the state of an oxygen storage catalyst provided in a vehicle.

2. Description of Related Art

In a vehicle equipped with an internal combustion engine, there is generally provided a three-way catalyst for purifying exhaust gas emitted from the internal combustion engine. The three-way catalyst is a catalyst for purifying, through oxidation reactions and reduction reactions, each of carbon monoxide, hydrocarbons and nitrogen oxides contained in the exhaust gas.

It is known that the purification rate in a three-way catalyst is highest when the air-fuel ratio of the exhaust gas is close to the so-called "stoichiometric air-fuel ratio". In other words, the purification rate in a three-way catalyst is lowered when the air-fuel ratio of the exhaust gas flowing into the three-way catalyst is richer than the stoichiometric air-fuel ratio or leaner than the stoichiometric air-fuel ratio.

Therefore, a three-way catalyst is generally configured as an "oxygen storage catalyst" which is provided with an ability to store and release oxygen. When the air-fuel ratio of the inflowing exhaust gas is leaner than the stoichiometric air-fuel ratio, oxygen is stored into the oxygen storage catalyst, causing the air-fuel ratio inside the oxygen storage catalyst to approach the stoichiometric air-fuel ratio. On the other hand, when the air-fuel ratio of the inflowing exhaust gas is richer than the stoichiometric air-fuel ratio, oxygen is released from the oxygen storage catalyst, causing the air-fuel ratio inside the oxygen storage catalyst to approach the stoichiometric air-fuel ratio. Consequently, even when the air-fuel ratio of the inflowing exhaust gas is deviated from the stoichiometric air-fuel ratio, it is still possible to maintain a high purification rate of the exhaust gas by the catalyst.

However, upon the oxygen storage amount reaching an oxygen storage capacity, it will become impossible for the oxygen storage catalyst to store any more oxygen. In such a state, the purification rate for lean exhaust gas will be lowered. On the other hand, upon the oxygen storage amount becoming almost 0, it will become impossible for the oxygen storage catalyst to release any more oxygen. In such a state, the purification rate for rich exhaust gas will be lowered.

SUMMARY

According to the present disclosure, there is provided a state estimation apparatus for estimating the state of an oxygen storage catalyst provided in a vehicle. The state estimation apparatus includes: a rate calculating unit configured to calculate, based on both a flow rate and an air-fuel ratio of exhaust gas flowing into the oxygen storage catalyst, a rate of change in an oxygen storage amount in the oxygen storage catalyst; a limit calculating unit configured to calculate a limit rate which is a limit value for the rate of change; and a storage-amount updating unit configured to update, based on the rate of change and the limit rate, an estimated value of the oxygen storage amount. Moreover, the storage-amount updating unit is further configured to: update, when the rate of change does not exceed the limit rate, the estimated value based on the rate of change; and update, when the rate of change exceeds the limit rate, the estimated value based on the limit rate.

DESCRIPTION OF EMBODIMENTS

Figure 1:
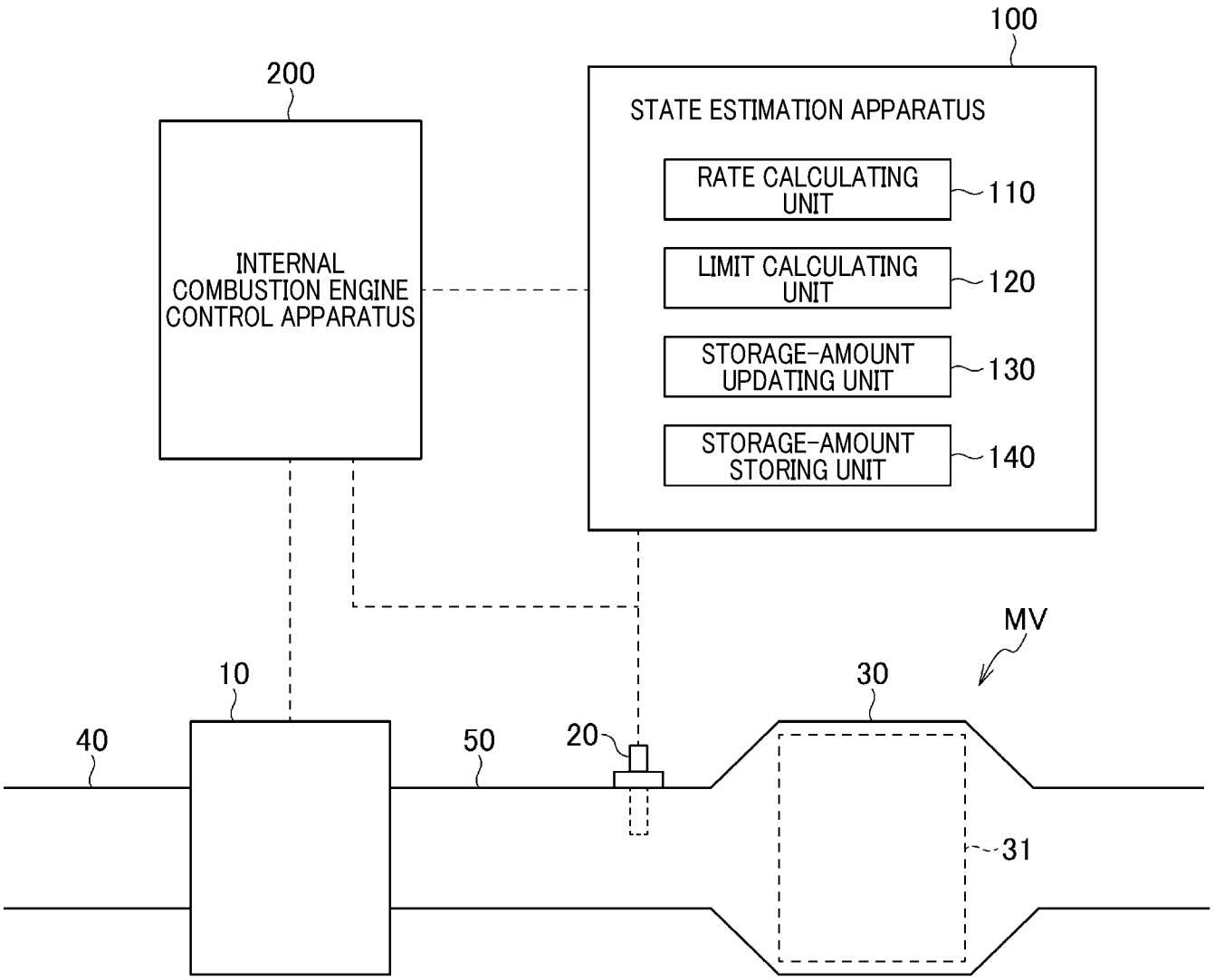
FIG. 1 is a diagram schematically illustrating the configurations of a state estimation apparatus according to a first embodiment and a vehicle equipped with the state estimation apparatus.

In a known exhaust gas purification apparatus (see, for example, Japanese Patent Application Publication No. JP 2000-120475 A), the oxygen storage amount in the oxygen storage catalyst is constantly estimated and the air-fuel ratio of the exhaust gas emitted from the internal combustion engine is regulated to bring the estimated value into agreement with a predetermined target value. Consequently, the oxygen storage amount in the oxygen storage catalyst is prevented from reaching the oxygen storage capacity and from becoming almost 0.

Moreover, in the known exhaust gas purification apparatus, addition or subtraction is performed on the estimated value of the oxygen storage amount each time a predetermined control period elapses, thereby updating the estimated value to the latest one. In this case, the value added to or subtracted from the estimated value can be referred to as the rate of change in the estimated value. In the known exhaust gas purification apparatus, the rate of change is calculated based on both the air-fuel ratio of the exhaust gas measured by an air-fuel ratio sensor and the flow rate of the exhaust gas flowing through the oxygen storage catalyst. Specifically, the leaner the measured air-fuel ratio, the higher the rate of increase in the estimated value of the oxygen storage amount is calculated to be. Moreover, the richer the measured air-fuel ratio, the higher the rate of decrease in the estimated value of the oxygen storage amount is calculated to be. Furthermore, the higher the flow rate of the exhaust gas, the higher the rate of change in the estimated value of the oxygen storage amount is calculated to be. In this manner, the rate of change in the oxygen storage amount in the oxygen storage catalyst varies according to the air-fuel ratio and the flow rate of the exhaust gas.

From the results of experiments conducted by the inventors of the present application, it has been found that there is a limit rate, depending on the situation, for the rate of change in the oxygen storage amount. For example, when the oxygen storage amount increases, the rate of increase does not exceed the limit rate for the time of increase. Similarly, when the oxygen storage amount decreases, the rate of decrease does not exceed the limit rate for the time of decrease.

In the known exhaust gas purification apparatus, the rate of change is calculated without taking into account the aforementioned limit rate and the estimated value of the oxygen storage amount is updated based on the thus-calculated rate of change. Therefore, the estimated value updated as above may deviate from the actual oxygen storage amount.

In contrast, in the above-described state estimation apparatus according to the present disclosure, the rate calculating unit calculates the rate of change in the oxygen storage amount in the oxygen storage catalyst based on both the flow rate and the air-fuel ratio of the exhaust gas flowing into the oxygen storage catalyst. The storage-amount updating unit updates the estimated value of the oxygen storage amount basically based on the rate of change. Consequently, it is possible to estimate the oxygen storage amount according to the conditions such as the air-fuel ratio.

However, when the rate of change exceeds the limit rate, the storage-amount updating unit updates the estimated value based on the limit rate; on the other hand, when the rate of change does not exceed the limit rate, the storage-amount updating unit updates the estimated value based on the rate of change as described above. With the above configuration of the state estimation apparatus, it is possible to more accurately estimate the oxygen storage amount by taking into account the limit rate.

Hereinafter, exemplary embodiments will be described with reference to the accompanying drawings. For the sake of facilitating understanding of the description, identical components are designated, where possible, with the same reference signs in the drawings; repeated explanations of identical components are omitted.

A first embodiment will be described. A state estimation apparatus 100 according to the first embodiment is provided, together with an oxygen storage catalyst 31 to be described later, in a vehicle MV. The state estimation apparatus 100 is configured to estimate the state of the oxygen storage catalyst 31. Prior to explanation of the state estimation apparatus 100, explanation will be first given of the configuration of the vehicle MV where the state estimation apparatus 100 is installed.

In FIG. 1, there is schematically illustrated the configuration of part of the vehicle MV. The vehicle MV is configured as a vehicle that runs on the driving power of an internal combustion engine 10.

The internal combustion engine 10, which is a so-called engine, generates the driving power for the vehicle MV through the internal combustion of fuel supplied together with air. To the internal combustion engine 10, there are connected an intake pipe 40 and an exhaust pipe 50.

The intake pipe 40 is a pipe through which air and fuel are supplied to the internal combustion engine 10. In the intake pipe 40, there are provided a throttle valve (not shown) for adjusting the air flow rate, an air flow meter (not shown) for measuring the air flow rate, and the like.

The exhaust pipe 50 is a pipe through which the exhaust gas generated by the combustion in the internal combustion engine 10 is exhausted to the outside of the vehicle MV. In the exhaust pipe 50, there are provided a purification apparatus 30 and an air-fuel ratio sensor 20.

The purification apparatus 30 is an apparatus for purifying the exhaust gas flowing through the exhaust pipe 50 in advance before the exhaust gas is exhausted to the outside. An oxygen storage catalyst 31 is received inside the purification apparatus 30. The oxygen storage catalyst 31 is a so-called three-way catalyst provided with an ability to store and release oxygen. The amount of oxygen stored in the oxygen storage catalyst 31 will be referred to as the "oxygen storage amount" hereinafter.

The oxygen storage catalyst 31 is configured with a base member formed of a ceramic and members each being supported on the base member. Those members which are supported on the base member include: a noble metal having a catalytic action, such as platinum; a support material supporting the noble metal, such as alumina; and a substance having both an oxygen-storing ability and an oxygen-releasing ability, such as ceria. Upon being heated by the exhaust gas to a predetermined activation temperature, the oxygen storage catalyst 31 purifies unburned gases, such as hydrocarbons and carbon monoxide, and nitrogen oxides at the same time.

When the air-fuel ratio of the exhaust gas flowing into the purification apparatus 30 is leaner than the stoichiometric air-fuel ratio, oxygen is stored into the oxygen storage catalyst 31, causing the air-fuel ratio inside the oxygen storage catalyst 31 to approach the stoichiometric air-fuel ratio. Moreover, when the air-fuel ratio of the exhaust gas flowing into the purification apparatus 30 is richer than the stoichiometric air-fuel ratio, oxygen is released from the oxygen storage catalyst 31, causing the air-fuel ratio inside the oxygen storage catalyst 31 to approach the stoichiometric air-fuel ratio. Consequently, even when the air-fuel ratio of the exhaust gas flowing into the purification apparatus 30 is deviated from the stoichiometric air-fuel ratio, it is still possible to maintain a high purification rate of the exhaust gas by the oxygen storage catalyst 31.

The air-fuel ratio sensor 20 is a sensor for measuring the air-fuel ratio of the exhaust gas flowing through the exhaust pipe 50. The air-fuel ratio sensor 20 is provided at a position upstream of the purification apparatus 30 in the exhaust pipe 50. Therefore, the air-fuel ratio measured by the air-fuel ratio sensor 20 is the air-fuel ratio of the exhaust gas flowing into the purification apparatus 30.

The air-fuel ratio sensor 20 outputs a signal according to the air-fuel ratio of the exhaust gas. Specifically, the magnitude of the output current is varied according to the oxygen concentration in the exhaust gas. The output current indicative of the magnitude of the measured air-fuel ratio is inputted from the air-fuel ratio sensor 20 to both the state estimation apparatus 100 and an internal combustion engine control apparatus 200.

In a relatively wide range of the air-fuel ratio, the air-fuel ratio sensor 20 changes the output current with a substantially constant slope according to the change in the air-fuel ratio. That is, the air-fuel ratio sensor 20 is configured as a so-called "linear sensor".

In addition, as a sensor for detecting the air-fuel ratio, besides the air-fuel ratio sensor 20 described above, a sensor called "O2 sensor" is also known. An O2 sensor is a sensor that sharply changes its output in a range where the air-fuel ratio is close to the stoichiometric air-fuel ratio and outputs a substantially constant value in the other ranges. In realizing functions of the state estimation apparatus 100 to be described later, it is possible to employ an O2 sensor instead of the air-fuel ratio sensor 20. However, with an O2 sensor, it is difficult to accurately acquire the value of the air-fuel ratio; moreover, there is a problem that the output characteristics have hysteresis. Therefore, as a sensor for detecting the air-fuel ratio, it is preferable to employ the air-fuel ratio sensor 20 which is a linear sensor as in the present embodiment.

As the configuration of the air-fuel ratio sensor 20 as described above, a known configuration may be employed. Therefore, explanation and graphical illustration of the detailed configuration of the air-fuel ratio sensor 20 will be omitted hereinafter.

In the vehicle MV, there is installed the internal combustion engine control apparatus 200. The internal combustion engine control apparatus 200 is an apparatus for controlling operation of the internal combustion engine 10. The internal combustion engine control apparatus 200 is implemented by a so-called "engine ECU".

The internal combustion engine control apparatus 200 adjusts the flow rate of air flowing into the internal combustion engine 10 via the intake pipe 40 by adjusting the opening degree of the not-shown throttle valve. Moreover, the internal combustion engine control apparatus 200 adjusts the amount of fuel supplied to the internal combustion engine 10 by controlling the opening/closing operation of fuel injection valves (not shown).

As described above, to the internal combustion engine control apparatus 200, there is inputted the air-fuel ratio measured by the air-fuel ratio sensor 20. The internal combustion engine control apparatus 200 controls the operations of the throttle valve and the fuel injection valves so as to bring the air-fuel ratio into agreement with a predetermined target air-fuel ratio. The target air-fuel ratio is set to, for example, the stoichiometric air-fuel ratio. However, it should be noted that the target air-fuel ratio may alternatively be set to other values than the stoichiometric air-fuel ratio.

In addition, it is possible to provide an additional air-fuel ratio sensor or O2 sensor at a position downstream of the purification apparatus 30 in the exhaust pipe 50 and suitably adjust the target air-fuel ratio based on a signal outputted from the downstream-side sensor. Moreover, it is also possible to provide an additional purification apparatus at a position more downstream than the purification apparatus 30.

Next, the configuration of the state estimation apparatus 100 will be described with reference to FIG. 1. The state estimation apparatus 100 according to the present embodiment is configured as an apparatus for estimating the state of the oxygen storage catalyst 31, more particularly, for estimating the oxygen storage amount in the oxygen storage catalyst 31.

Bidirectional communication can be performed between the state estimation apparatus 100 and the internal combustion engine control apparatus 200 via an in-vehicle network. Through the communication, the internal combustion engine control apparatus 200 can acquire an estimated value of the oxygen storage amount from the state estimation apparatus 100. Moreover, the state estimation apparatus 100 can acquire the operating state of the internal combustion engine 10 from the internal combustion engine control apparatus 200. Furthermore, the state estimation apparatus 100 can also acquire, via the internal combustion engine control apparatus 200, the measured values of the sensors provided in respective parts of the vehicle MV.

In addition, in the present embodiment, the state estimation apparatus 100 is configured as a separate apparatus from the internal combustion engine control apparatus 200. However, the state estimation apparatus 100 may alternatively be configured as an apparatus integrated with the internal combustion engine control apparatus 200. In other words, the state estimation apparatus 100 may alternatively be configured as a part of the internal combustion engine control apparatus 200 which is implemented by an engine ECU.

The state estimation apparatus 100 includes a rate calculating unit 110, a limit calculating unit 120, a storage-amount storing unit 140 and a storage-amount updating unit 130 as functional control blocks.

The rate calculating unit 110 is a unit for calculating the rate of change in the oxygen storage amount in the oxygen storage catalyst 31. The rate calculating unit 110 calculates the rate of change by the following equation (1):

$$\text{Rate of change}=(\text{Catalyst stoichiometric equivalence ratio}-\text{Inflow equivalence ratio})\times\text{Intake air flow rate}\times 0.232\times\text{Calculation period} \quad (1)$$

The "equivalence ratio" is an index indicating the air-fuel ratio of the exhaust gas, and is a value obtained by dividing the stoichiometric air-fuel ratio by the air-fuel ratio of the exhaust gas. The "inflow equivalence ratio" in the equation (1) is the equivalence ratio of the exhaust gas flowing into the oxygen storage catalyst 31. The inflow equivalence ratio is calculated based on the measured value of the air-fuel ratio sensor 20.

When the inflow equivalence ratio is low, for example, when the air-fuel ratio of the exhaust gas is extremely on the lean side of the stoichiometric air-fuel ratio, the oxygen storage amount in the oxygen storage catalyst 31 will gradually increase. In contrast, when the inflow equivalence ratio is high, for example, when the air-fuel ratio of the exhaust gas is extremely on the rich side of the stoichiometric air-fuel ratio, the oxygen storage amount in the oxygen storage catalyst 31 will gradually decrease. The "catalyst stoichiometric equivalence ratio" in the equation (1) is the value of the inflow equivalence ratio when the oxygen storage amount in the oxygen storage catalyst 31 neither increases nor decreases.

The "intake air flow rate" in the equation (1) is the flow rate of the exhaust gas flowing into the oxygen storage catalyst 31. Specifically, it represents the mass of the exhaust gas flowing into the oxygen storage catalyst 31 per unit time. In the present embodiment, the flow rate of air supplied via the intake pipe 40 to the internal combustion engine 10, that is, the value of the flow rate measured by the not-shown air flow meter is used as the intake air flow rate.

The intake air flow rate may be obtained by a method different from the above. For example, the intake air flow rate may be calculated at all times based on the rotational speed of the internal combustion engine 10, the opening degree of the throttle valve and the like.

"0.232" in the equation (1) is a numerical value indicating the percentage of the mass of oxygen contained in the air.

The "calculation period" in the equation (1) is the period at which the process of FIG. 5 to be described later is repeated. In addition, due to being multiplied by the calculation period at the end, the value calculated by the equation (1) indicates the oxygen storage amount, which increases or decreases within the calculation period, in the dimension of mass. However, since the calculation period is generally constant, the value calculated by the equation (1) is substantially a value indicating the rate of change in the oxygen storage amount.

As above, the rate calculating unit 110 calculates, based on both the flow rate and the air-fuel ratio of the exhaust gas flowing into the oxygen storage catalyst 31, the rate of change in the oxygen storage amount in the oxygen storage catalyst 31.

The limit calculating unit 120 is a unit for calculating a limit rate which is a limit value for the above-described rate of change. The actual rate of change in the oxygen storage amount in the oxygen storage catalyst 31 is not always in agreement with the rate of change calculated by the equation (1). For example, when the oxygen storage amount in the oxygen storage catalyst 31 becomes close to 100%, the rate of increase in the oxygen storage amount in the calculation period is limited to a limit rate lower than the rate of change calculated by the equation (1).

The limit calculating unit 120 calculates, as the limit rate, both a limit increase rate and a limit decrease rate. The limit increase rate is a limit value for the rate at which the oxygen storage amount increases. That is, the limit increase rate is a limit value for the rate at which oxygen is stored into the oxygen storage catalyst 31. On the other hand, the limit decrease rate is a limit value for the rate at which the oxygen storage amount decreases. That is, the limit decrease rate is a limit value for the rate at which oxygen is released from the oxygen storage catalyst 31.

The limit calculating unit 120 calculates the limit increase rate by the following equation (2):

$$\text{Limit increase rate}=\text{Storage rate coefficient}\times(\text{Catalyst stoichiometric equivalence ratio}-\text{Inflow equivalence ratio})\times(\text{Oxygen storage capacity}-\text{Current oxygen storage amount})\times\text{Calculation period} \quad (2)$$

The "storage rate coefficient" in the equation (2) is a coefficient indicating the ease of oxygen being stored into the oxygen storage catalyst 31. The storage rate coefficient is a constant that is set in advance, based on an experiment or the like, according to the individual oxygen storage catalyst 31.

The "oxygen storage capacity" in the equation (2) is the maximum amount of oxygen that can be stored in the oxygen storage catalyst 31. Similar to the above-described storage rate coefficient, the oxygen storage capacity is a constant that is set in advance, based on an experiment or the like, according to the individual oxygen storage catalyst 31. In addition, the maximum amount of oxygen that can be stored in the oxygen storage catalyst 31 may change depending on the history of the exhaust gas flowing through the oxygen storage catalyst 31. Therefore, the oxygen storage capacity may not be always set to a constant value, but may be corrected at all times according to the conditions.

The "current oxygen storage amount" in the equation (2) is the latest estimated value of the oxygen storage amount calculated by the state estimation apparatus 100, and is an estimated value that is stored in the storage-amount storing unit 140 to be described later.

The limit calculating unit 120 calculates the limit decrease rate by the following equation (3):

$$\text{Limit decrease rate}=\text{Release rate coefficient}\times(\text{Catalyst stoichiometric equivalence ratio}-\text{Inflow equivalence ratio})\times(\text{Current oxygen storage amount})\times\text{Calculation period} \quad (3)$$

The "release rate coefficient" in the equation (3) is a coefficient indicating the ease of oxygen being released from the oxygen storage catalyst 31. The release rate coefficient is a constant that is set in advance, based on an experiment or the like, according to the individual oxygen storage catalyst 31.

The storage-amount storing unit 140 is a unit for storing an estimated value of the oxygen storage amount calculated by the state estimation apparatus 100. The state estimation apparatus 100 calculates an estimated value of the oxygen storage amount each time the constant calculation period elapses, and stores it in the storage-amount storing unit 140.

The storage-amount updating unit 130 is a unit for performing a process of updating the estimated value stored in the storage-amount storing unit 140 to the latest one. The storage-amount updating unit 130 performs the process of updating the estimated value of the oxygen storage amount based on both the rate of change calculated by the rate calculating unit 110 and the limit rate calculated by the limit calculating unit 120. The details of the process performed by the storage-amount updating unit 130 will be described later.

Upon the oxygen storage amount in the oxygen storage catalyst 31 reaching the oxygen storage capacity, it will become impossible for the oxygen storage catalyst 31 to store any more oxygen. In such a state, the purification rate for lean exhaust gas will be lowered. On the other hand, upon the oxygen storage amount in the oxygen storage catalyst 31 becoming almost 0, it will become impossible for the oxygen storage catalyst 31 to release any more oxygen. In such a state, the purification rate for rich exhaust gas will be lowered. Therefore, in the present embodiment, the internal combustion engine control apparatus 200 performs a process to be described later, so as to keep the oxygen storage amount in the oxygen storage catalyst 31 in the vicinity of a target storage amount. Consequently, the oxygen storage amount is prevented from reaching the oxygen storage capacity and from becoming almost 0.

Figure 2:
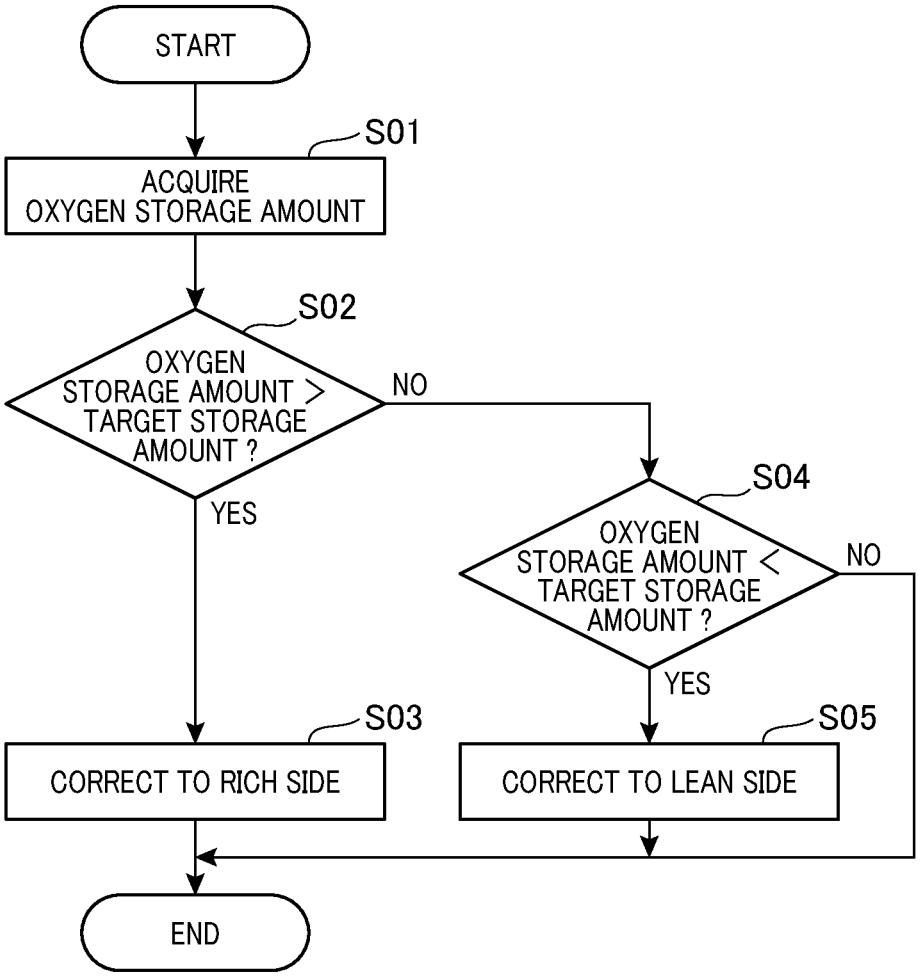
FIG. 2 is a flow chart illustrating the flow of processes executed by an internal combustion engine control apparatus shown in FIG. 1.

A series of processes shown in FIG. 2 is repeatedly executed by the internal combustion engine control apparatus 200 each time the calculation period elapses. In addition, as described above, the internal combustion engine control apparatus 200 performs a process of controlling the operation of the internal combustion engine 10 so as to bring the air-fuel ratio measured by the air-fuel ratio sensor 20 into agreement with the target air-fuel ratio. The series of processes shown in FIG. 2 is executed separately from and in parallel with the above process.

In the first step S01, a process of acquiring the oxygen storage amount is performed. The oxygen storage amount acquired in this step is the current oxygen storage amount estimated by the state estimation apparatus 100. The internal combustion engine control apparatus 200 acquires, through communication, the estimated value of the oxygen storage amount which is stored in the storage-amount storing unit 140 of the state estimation apparatus 100.

In step S02 subsequent to step S01, it is determined whether the oxygen storage amount acquired in step S01 is larger than the target storage amount. The target storage amount is set to, for example, 50%, i.e., ½ of the oxygen storage capacity. However, the target storage amount may alternatively be set to a value different from the above value. Moreover, the target storage amount may not be always set to a constant value, but may be corrected at all times according to the conditions.

If the oxygen storage amount is determined to be larger than the target storage amount, the flow proceeds to step S03. In step S03, a process of changing the operating state of the internal combustion engine 10 is performed so as to change the air-fuel ratio of the exhaust gas emitted from the internal combustion engine 10 to a value on the rich side of the current value. This process is performed by, for example, changing the above-described target air-fuel ratio to a value on the rich side.

Upon the air-fuel ratio of the exhaust gas being changed to a value on the rich side, the tendency for the oxygen storage amount to increase is reduced. Moreover, with the process of step S03 being repeatedly performed, the oxygen storage amount gradually decreases to approach the target storage amount.

If the oxygen storage amount is determined in step S02 to be not larger than the target storage amount, the flow proceeds to step S04. In step S04, it is further determined whether the oxygen storage amount acquired in step S01 is smaller than the target storage amount. If the oxygen storage amount is determined to be smaller than the target storage amount, the flow proceeds to step S05. In step S05, a process of changing the operating state of the internal combustion engine 10 is performed so as to change the air-fuel ratio of the exhaust gas emitted from the internal combustion engine 10 to a value on the lean side of the current value. This process is performed by, for example, changing the above-described target air-fuel ratio to a value on the lean side.

Upon the air-fuel ratio of the exhaust gas being changed to a value on the lean side, the tendency for the oxygen storage amount to decrease is reduced. Moreover, with the process of step S05 being repeatedly performed, the oxygen storage amount gradually increases to approach the target storage amount.

If the oxygen storage amount is determined in step S04 to be not smaller than the target storage amount, that is, if the oxygen storage amount is equal to the target storage amount, the series of processes shown in FIG. 2 terminates without performing a process of changing the operating state of the internal combustion engine 10.

With the above processes performed by the internal combustion engine control apparatus 200, the oxygen storage amount is kept in the vicinity of the target storage amount. Consequently, the performance of purifying the exhaust gas by the purification apparatus 30 is maintained.

Figure 3:
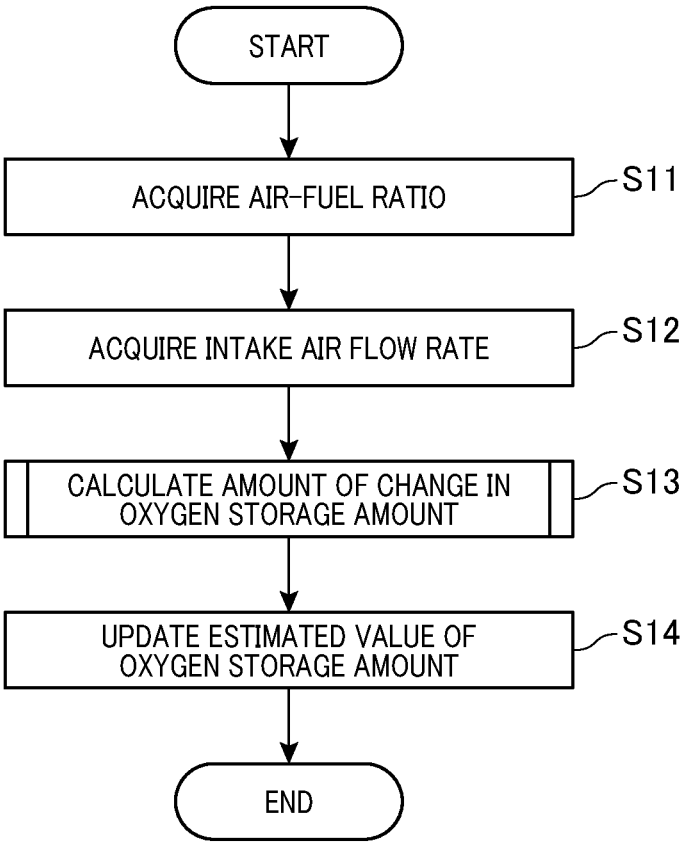
FIG. 3 is a flow chart illustrating the flow of processes executed by the state estimation apparatus according to the first embodiment.

Next, the details of processes performed by the state estimation apparatus 100 will be described. A series of processes shown in FIG. 3 is repeatedly executed by the state estimation apparatus 100 each time the calculation period elapses. In addition, the processes shown in FIG. 3 may be executed only when a predetermined execution condition is satisfied. The execution condition may include, for example, that the warming up of the vehicle MV has been completed.

In the first step S11, a process of acquiring the air-fuel ratio of the exhaust gas flowing into the purification apparatus 30 is performed. Specifically, the air-fuel ratio measured by the air-fuel ratio sensor 20 is acquired as the air-fuel ratio of the exhaust gas.

In step S12 subsequent to step S11, a process of acquiring the intake air flow rate is performed. Specifically, as described above, the flow rate measured by the not-shown air flow meter is acquired as the intake air flow rate.

In step S13 subsequent to step S12, a process of calculating the amount of change in the oxygen storage amount is performed. The "amount of change" here denotes the amount of change in the oxygen storage amount during the period from the execution of the processes shown in FIG. 3 in the previous calculation cycle to the execution of the same in the current calculation cycle. When oxygen is being stored into the oxygen storage catalyst 31, the amount of change is calculated to be a positive value. In contrast, when oxygen is being released from the oxygen storage catalyst 31, the amount of change is calculated to be a negative value. The details of the process performed for calculating the amount of change will be described later.

In step S14 subsequent to step S13, a process of updating the estimated value of the oxygen storage amount is performed. Specifically, a process of storing the latest estimated value in the storage-amount storing unit 140 is performed; the latest estimated value is a value obtained by adding the amount of change calculated in step S13 to the current estimated value stored in the storage-amount storing unit 140. This process is performed by the storage-amount updating unit 130.

With repeated execution of the above processes, there is always stored the latest estimated value in the storage-amount storing unit 140. In addition, the latest estimated value is sent to the internal combustion engine control apparatus 200 upon request.

Figure 4:
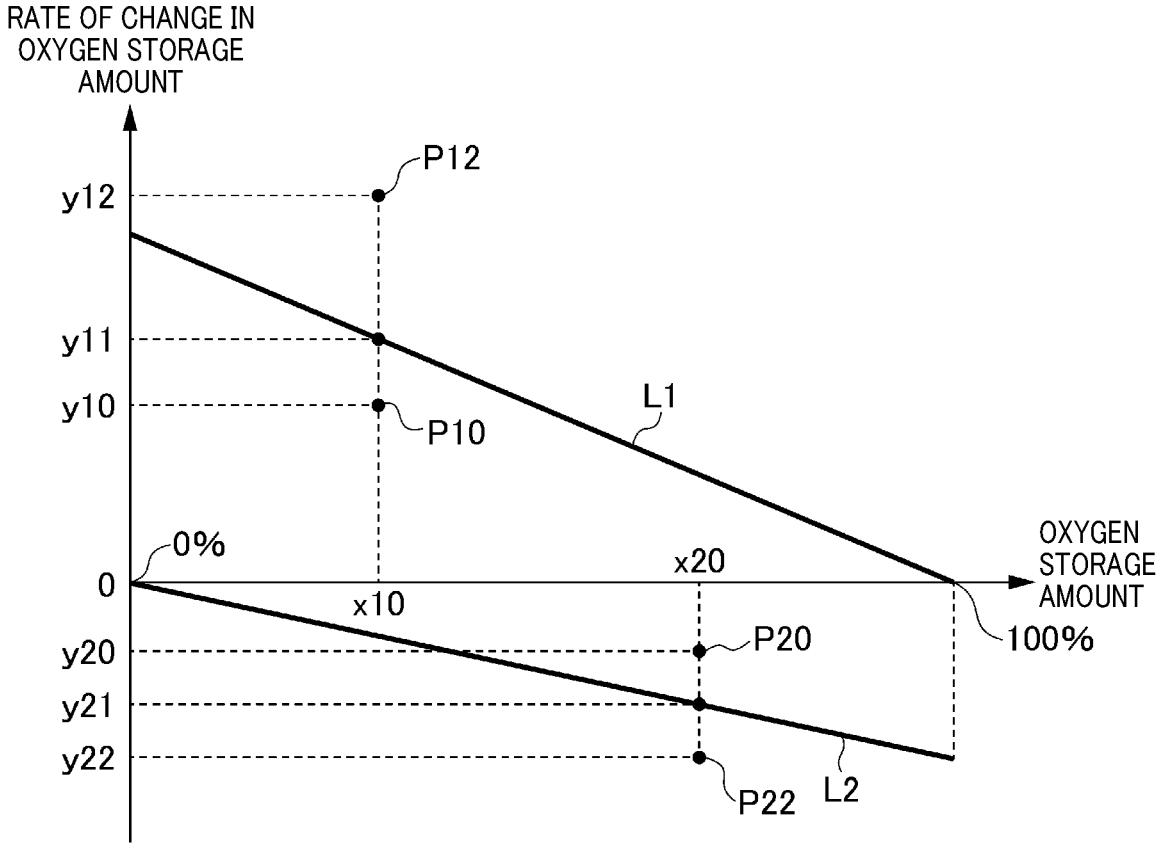
FIG. 4 is a diagram illustrating the rate of change and the limit rate for an oxygen storage amount.

The outline of the process performed in step S13 will be described with reference to FIG. 4. The horizontal axis of the graph shown in FIG. 4 represents the oxygen storage amount in the range of 0% to 100% (i.e., the oxygen storage capacity). The vertical axis of the graph represents the rate of change in the oxygen storage amount.

Moreover, the line L1 shown in FIG. 4 represents the limit increase rate calculated by the limit calculating unit 120. As indicated by the line L1, the limit increase rate decreases with increase in the oxygen storage amount; the limit increase rate becomes 0 when the oxygen storage amount is 100%. That is, the larger the oxygen storage amount, the smaller the absolute value of the limit increase rate calculated by the limit calculating unit 120.

The line L2 shown in FIG. 4 represents the limit decrease rate calculated by the limit calculating unit 120. As indicated by the line L2, the absolute value of the limit decrease rate decreases with decrease in the oxygen storage amount; the limit decrease rate becomes 0 when the oxygen storage amount is 0%. That is, the smaller the oxygen storage amount, the smaller the absolute value of the limit decrease rate calculated by the limit calculating unit 120.

In FIG. 4, there is illustrated, by a plurality of points P10 and the like, an example of the rate of change calculated by the rate calculating unit 110. Each of the points P10 and P12 represents the rate of change calculated when the oxygen storage amount is equal to x10. On the other hand, each of the points P20 and P22 represents the rate of change calculated when the oxygen storage amount is equal to x20.

In the example illustrated in FIG. 4, the calculated rate of change at the point P10 is equal to y10; y10 is higher than 0 and lower than the limit increase rate at the oxygen storage amount of x10. That is, the calculated rate of change y10 is a value that does not exceed the limit increase rate. In addition, in the explanation given hereinafter, the expression "the rate of change exceeds the limit rate" denotes that the absolute value of the rate of change becomes larger than the absolute value of the limit rate.

In this case, the rate of change y10 calculated by the rate calculating unit 110 is substantially equal to the actual rate of change. Therefore, in step S13 of FIG. 3, y10 is directly used as the amount of change. Further, in step S14 of the same figure, the estimated value of the oxygen storage amount is increased by y10.

In the example illustrated in FIG. 4, the calculated rate of change at the point P12 is equal to y12; y12 is higher than 0 and even higher than the limit increase rate at the oxygen storage amount of x10. That is, the calculated rate of change y12 is a value that exceeds the limit increase rate.

As described previously, the actual rate of change in the oxygen storage amount does not increase above the limit increase rate. Therefore, when the calculated rate of change is equal to y12, the actual rate of change is determined to be equal to the limit increase rate at the oxygen storage amount of x10. In FIG. 4, such an actual rate of change is designated by y11. In this case, in step S13 of FIG. 3, y11 is used as the amount of change. Further, in step S14 of the same figure, the estimated value of the oxygen storage amount is increased by y11.

If y12 was used as the amount of change without taking into account the limit increase rate, the estimated value of the oxygen storage amount would become larger than the actual value. Consequently, for example, a process for causing oxygen to be released from the oxygen storage catalyst 31 might be performed more than necessary and thus rich exhaust gas might be emitted to the outside. In contrast, in the state estimation apparatus 100 according to the present embodiment, the amount of change is calculated taking into account the limit increase rate. Consequently, it becomes possible to always accurately update the estimated value of the oxygen storage amount.

In the example illustrated in FIG. 4, the calculated rate of change at the point P20 is equal to y20; y20 is lower than 0 and higher than the limit decrease rate at the oxygen storage amount of x20. That is, the calculated rate of change y20 is a value that does not exceed the limit decrease rate.

In this case, the rate of change y20 calculated by the rate calculating unit 110 is substantially equal to the actual rate of change. Therefore, in step S13 of FIG. 3, y20 is directly used as the amount of change. Further, in step S14 of the same figure, the estimated value of the oxygen storage amount is reduced by y20.

In the example illustrated in FIG. 4, the calculated rate of change at the point P22 is equal to y22; y22 is lower than 0 and even lower than the limit decrease rate at the oxygen storage amount of x20. That is, the calculated rate of change y22 is a value that exceeds the limit decrease rate.

As described previously, the absolute value of the actual rate of change in the oxygen storage amount does not increase to exceed the limit decrease rate. Therefore, when the calculated rate of change is equal to y22, the actual rate of change is determined to be equal to the limit decrease rate at the oxygen storage amount of x20. In FIG. 4, such an actual rate of change is designated by y21. In this case, in step S13 of FIG. 3, y21 is used as the amount of change. Further, in step S14 of the same figure, the estimated value of the oxygen storage amount is reduced by y21.

If y22 was used as the amount of change without taking into account the limit decrease rate, the estimated value of the oxygen storage amount would become smaller than the actual value. Consequently, for example, a process for causing oxygen to be stored into the oxygen storage catalyst 31 might be performed more than necessary and thus lean exhaust gas might be emitted to the outside. In contrast, in the state estimation apparatus 100 according to the present embodiment, the amount of change is calculated taking into account the limit decrease rate. Consequently, it becomes possible to always accurately update the estimated value of the oxygen storage amount.

Figure 5:
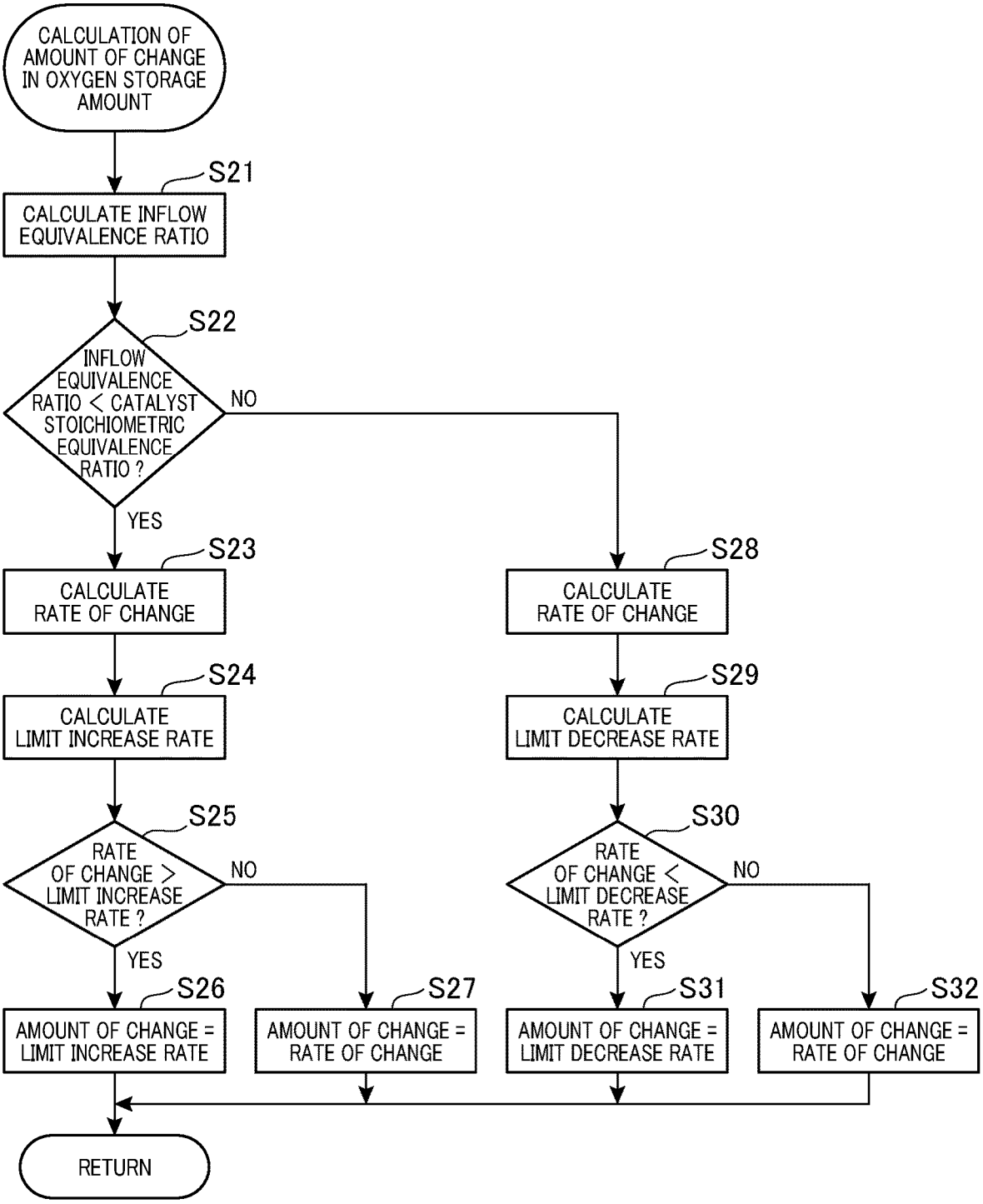
FIG. 5 is a flow chart illustrating the flow of a process executed by the state estimation apparatus according to the first embodiment.

Referring now to FIG. 5, explanation will be given of the details of the process performed by the state estimation apparatus 100 for realizing the calculation of the amount of change as described above. The flow chart shown in FIG. 5 illustrates the flow of the process executed in step S13 of FIG. 3. In addition, most of the process is performed by the storage-amount updating unit 130.

In the first step S21 of the process, a process of calculating the inflow equivalence ratio is performed. As described above, the inflow equivalence ratio is calculated based on the measured value of the air-fuel ratio sensor 20.

In step S22 subsequent to step S21, it is determined whether the inflow equivalence ratio calculated in step S21 is lower than the catalyst stoichiometric equivalence ratio.

If the inflow equivalence ratio is determined to be lower than the catalyst stoichiometric equivalence ratio, the flow proceeds to step S23. In this case, the oxygen storage amount will increase. In step S23, a process of calculating the rate of change in the oxygen storage amount is performed. In addition, this process is performed by the rate calculating unit 110 using the above-described equation (1).

In step S24 subsequent to step S23, a process of calculating the limit increase rate is performed. In addition, this process is performed by the limit calculating unit 120 using the above-described equation (2).

In step S25 subsequent to step S24, it is determined whether the rate of change calculated in step S23 is higher than the limit increase rate calculated in step S24.

If the rate of change is determined to be higher than the limit increase rate, the flow proceeds to step S26. In step S26, a process of substituting the value of the limit increase rate into the amount of change is performed. Consequently, in step S13 of FIG. 3, the value of the limit increase rate is used as the amount of change.

As described above, the storage-amount updating unit 130 according to the present embodiment updates, when the rate of change exceeds the limit increase rate, the estimated value on the basis of the limit increase rate.

If the rate of change is determined in step S25 to be lower than or equal to the limit increase rate, the flow proceeds to step S27. In step S27, a process of substituting the value of the rate of change into the amount of change is performed. Consequently, in step S13 of FIG. 3, the value of the rate of change is used as the amount of change.

As described above, the storage-amount updating unit 130 according to the present embodiment updates, when the rate of change does not exceed the limit increase rate, the estimated value on the basis of the rate of change.

If the inflow equivalence ratio is determined in step S22 to be higher than or equal to the catalyst stoichiometric equivalence ratio, the flow proceeds to step S28. In this case, the oxygen storage amount will decrease. In step S28, a process of calculating the rate of change in the oxygen storage amount is performed. In addition, this process is performed by the rate calculating unit 110 using the above-described equation (1).

In step S29 subsequent to step S28, a process of calculating the limit decrease rate is performed. In addition, this process is performed by the limit calculating unit 120 using the above-described equation (2).

In step S30 subsequent to step S29, it is determined whether the rate of change calculated in step S28 is lower than the limit decrease rate calculated in step S29.

If the rate of change is determined to be lower than the limit decrease rate, the flow proceeds to step S31. In step S31, a process of substituting the value of the limit decrease rate into the amount of change is performed. Consequently, in step S13 of FIG. 3, the value of the limit decrease rate is used as the amount of change.

As described above, the storage-amount updating unit 130 according to the present embodiment updates, when the rate of change exceeds the limit decrease rate, the estimated value on the basis of the limit decrease rate.

If the rate of change is determined in step S30 to be higher than or equal to the limit decrease rate, the flow proceeds to step S32. In step S32, a process of substituting the value of the rate of change into the amount of change is performed. Consequently, in step S13 of FIG. 3, the value of the rate of change is used as the amount of change.

As described above, the storage-amount updating unit 130 according to the present embodiment updates, when the rate of change does not exceed the limit decrease rate, the estimated value on the basis of the rate of change.

An example has been described above where the estimated value of the oxygen storage amount calculated by the state estimation apparatus 100 is used for control by the internal combustion engine control apparatus 100. However, the use of the calculated estimated value is not limited to the above. For example, an abnormality of the oxygen storage catalyst 31 or the like may be determined based on the estimated value of the oxygen storage amount; and the results of the determination may be notified to an occupant or the like.

Next, a second embodiment will be described. The second embodiment differs from the first embodiment in the calculation method of the limit rate by the limit calculating unit 120. Hereinafter, the differences of the second embodiment from the first embodiment will be mainly described; the commonalities to the first and second embodiments will be omitted as appropriate.

Figure 6:
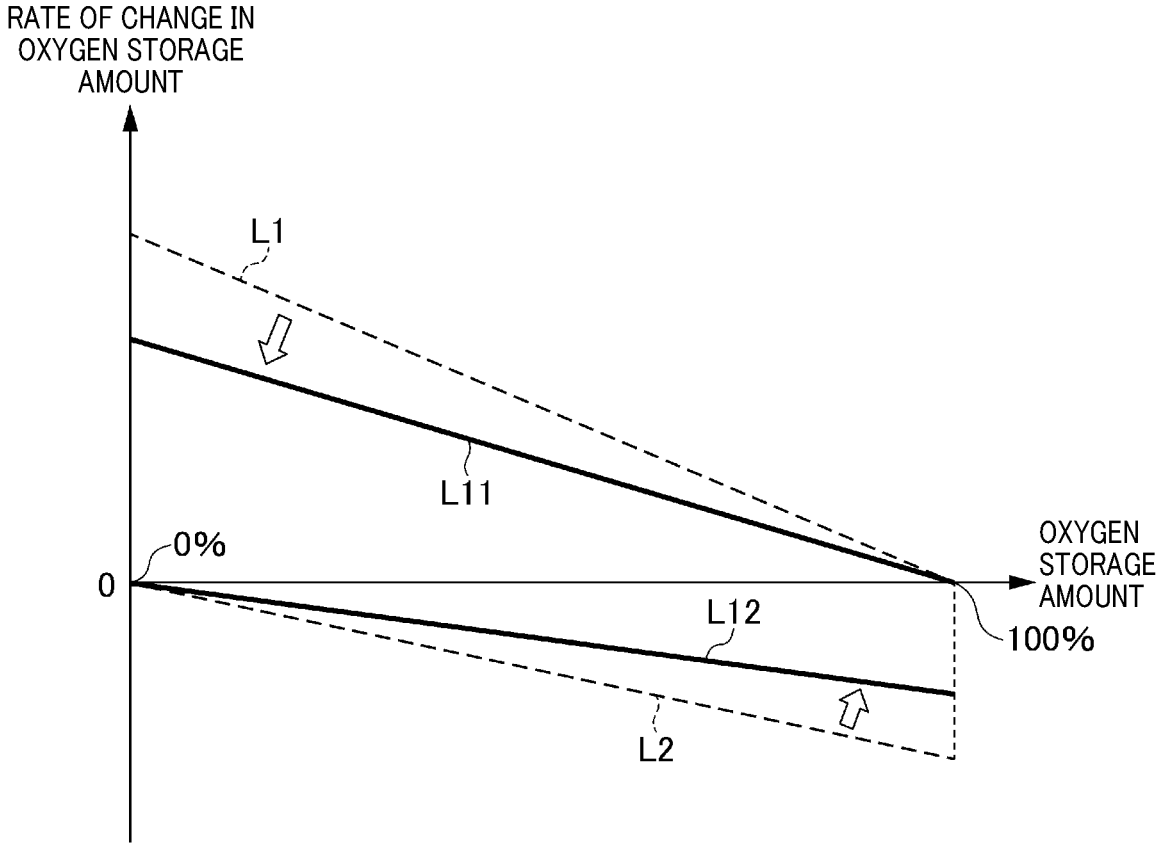
FIG. 6 is a diagram illustrating a process executed by a state estimation apparatus according to a second embodiment.

The line L1 shown in FIG. 6 is the same as the line L1 shown in FIG. 4. In the present embodiment, with decrease in the temperature of the oxygen storage catalyst 31, the limit increase rate calculated by the limit calculating unit 120 changes from the line L1 to the line L11. The line L11 is a straight line having a smaller slope than the line L1 and indicating that the limit increase rate becomes 0 when the oxygen storage amount is 100%. In any case where the oxygen storage amount is in the range from 0% to 100%, the absolute value of the limit increase rate calculated at low temperature is smaller than the absolute value of the limit increase rate calculated at normal temperature. Such a limit increase rate can be calculated, for example, by multiplying the value calculated by the equation (2) by a coefficient that decreases with the temperature of the oxygen storage catalyst 31.

From the results confirmed by the inventors of the present application through experiments and the like, it has been found that the absolute value of the limit increase rate decreases with decrease in the temperature of the oxygen storage catalyst 31. Therefore, the limit calculating unit 120 according to the present embodiment can calculate the limit increase rate more accurately.

The line L2 shown in FIG. 6 is the same as the line L2 shown in FIG. 4. In the present embodiment, with decrease in the temperature of the oxygen storage catalyst 31, the limit decrease rate calculated by the limit calculating unit 120 changes from the line L2 to the line L12. The line L12 is a straight line having a smaller slope than the line L2 and indicating that the limit decrease rate becomes 0 when the oxygen storage amount is 0%. In any case where the oxygen storage amount is in the range from 0% to 100%, the absolute value of the limit decrease rate calculated at low temperature is smaller than the absolute value of the limit decrease rate calculated at normal temperature. Such a limit decrease rate can be calculated, for example, by multiplying the value calculated by the equation (3) by a coefficient that decreases with the temperature of the oxygen storage catalyst 31.

From the results confirmed by the inventors of the present application through experiments and the like, it has been found that the absolute value of the limit decrease rate decreases with decrease in the temperature of the oxygen storage catalyst 31. Therefore, the limit calculating unit 120 according to the present embodiment can calculate the limit decrease rate more accurately.

As described above, in the present embodiment, the lower the temperature of the oxygen storage catalyst 31, the smaller the absolute values of the limit increase rate and the limit decrease rate calculated by the limit calculating unit 120. In addition, the correction of the limit rate based on the temperature of the oxygen storage catalyst 31 may be performed for both the limit increase rate and the limit decrease rate as described above; alternatively, the correction may be performed for only one of the limit increase rate and the limit decrease rate.

As above, the embodiments have been described with reference to the specific examples. However, the present disclosure is not limited to the specific examples. Modifications resulting from suitable design changes made by those skilled in the art to the specific examples are also included in the scope of the present disclosure as long as they have the features of the present disclosure. Elements included in the specific examples and their arrangements, conditions, shapes and the like are not limited to those illustrated, but may be suitably modified. The combinations of the elements included in the specific examples may be suitably changed as long as no technical contradiction arises.

The state estimation apparatus 100 and the internal combustion engine control apparatus 200 described in the present disclosure may be realized by one or more dedicated computers configured with a processor, which is programmed to perform one or more functions embodied by a computer program, and a memory. As an alternative, the state estimation apparatus 100 and the internal combustion engine control apparatus 200 may be realized by a dedicated computer configured with a processor including one or more dedicated hardware logic circuits. As another alternative, the state estimation apparatus 100 and the internal combustion engine control apparatus 200 may be realized by one or more dedicated computers configured with a combination of a processor programmed to perform one or more functions, a memory and a processor including one or more hardware logic circuits. The computer program may be stored, as instructions executed by the computer, in a computer-readable non-transitory tangible recording medium. The dedicated hardware logic circuits and the hardware logic circuits may be realized by a digital circuit that includes a plurality of logic circuits or by an analog circuit.

What is claimed is:

1. A state estimation apparatus for estimating a state of an oxygen storage catalyst provided in a vehicle, the state estimation apparatus comprising:

a rate calculating unit configured to calculate, based on both a flow rate and an air-fuel ratio of exhaust gas flowing into the oxygen storage catalyst, a rate of change in an oxygen storage amount in the oxygen storage catalyst;

a limit calculating unit configured to calculate a limit rate which is a limit value for the rate of change; and a storage-amount updating unit configured to update, based on the rate of change and the limit rate, an estimated value of the oxygen storage amount, wherein the storage-amount updating unit is further configured to:

update, when the rate of change does not exceed the limit rate, the estimated value based on the rate of change; and update, when the rate of change exceeds the limit rate, the estimated value based on the limit rate, and the limit calculating unit is further configured to calculate, as the limit rate, both:

a limit increase rate which is a limit value for a rate at which the oxygen storage amount increases; and a limit decrease rate which is a limit value for a rate at which the oxygen storage amount decreases.

2. The state estimation apparatus as set forth in claim 1, wherein the larger the oxygen storage amount, the smaller an absolute value of the limit increase rate calculated by the limit calculating unit becomes.

3. The state estimation apparatus as set forth in claim 1, wherein the smaller the oxygen storage amount, the smaller an absolute value of the limit decrease rate calculated by the limit calculating unit becomes.

4. The state estimation apparatus as set forth in claim 1, wherein the lower a temperature of the oxygen storage catalyst, the smaller at least one of an absolute value of the limit increase rate and an absolute value of the limit decrease rate calculated by the limit calculating unit becomes.

5. The state estimation apparatus as set forth in claim 1, wherein the rate calculating unit is configured to calculate the rate of change using a catalyst stoichiometric equivalence ratio and an inflow equivalence ratio;

the catalyst stoichiometric equivalence ratio is an index indicating the air-fuel ratio of the exhaust gas, and is a value obtained by dividing the stoichiometric air-fuel ratio by the air-fuel ratio of the exhaust gas; and the inflow equivalence ratio is an equivalence ratio of the exhaust gas flowing into the oxygen storage catalyst.

6. The state estimation apparatus as set forth in claim 1, wherein the limit calculating unit is configured to calculate the limit increase rate using a storage rate coefficient, an oxygen storage capacity, and a current oxygen storage amount;

the storage rate coefficient is a coefficient indicating an ease of oxygen being stored into the oxygen storage catalyst;

the oxygen storage capacity is a maximum amount of oxygen that can be stored in the oxygen storage catalyst; and a current oxygen storage amount is a latest estimated value of the oxygen storage amount calculated by the state estimation apparatus.

7. The state estimation apparatus as set forth in claim 1, wherein the limit calculating unit is configured to calculate the limit decrease rate using a release rate coefficient; and the release rate coefficient is a coefficient indicating an ease of oxygen being released from the oxygen storage catalyst.

8. The state estimation apparatus as set forth in claim 1, wherein an absolute value of the limit increase rate decreases with a decrease in a temperature of the oxygen storage catalyst.

9. The state estimation apparatus as set forth in claim 1, wherein an absolute value of the limit decrease rate decreases with a decrease in a temperature of the oxygen storage catalyst.

* * * * *